US006305349B1

(12) United States Patent
Harris

(10) Patent No.: US 6,305,349 B1
(45) Date of Patent: Oct. 23, 2001

(54) SLIDING GATE EXHAUST BRAKE ASSEMBLY

(75) Inventor: Victor Alan Harris, Arundel (GB)

(73) Assignee: Hersham Valves LTD, Arundel (GB)

( * ) Notice: Subject to any disclaimer, the term of this patent is extended or adjusted under 35 U.S.C. 154(b) by 0 days.

(21) Appl. No.: 09/563,202

(22) Filed: May 2, 2000

(30) Foreign Application Priority Data

Oct. 29, 1999 (GB) ..... 9925644

(51) Int. Cl.[7] ..... F02D 9/06
(52) U.S. Cl. ..... 123/323; 188/273; 137/630.12
(58) Field of Search ..... 123/323; 188/273; 60/324; 137/630.12

(56) References Cited

U.S. PATENT DOCUMENTS

| | | | |
|---|---|---|---|
| 4,205,704 | 6/1980 | Benson | 137/630.12 |
| 4,553,648 | 11/1985 | Suzuki et al. | 188/273 |
| 4,556,027 | 12/1985 | Harris | 123/323 |
| 4,669,585 | 6/1987 | Harris | 188/273 |
| 4,751,987 | 6/1988 | Takigawa et al. | 188/273 |
| 5,346,041 * | 9/1994 | Suzuki et al. | 188/273 |
| 5,630,392 | 5/1997 | Harris | 123/323 |

* cited by examiner

*Primary Examiner*—Andrew M. Dolinar
(74) *Attorney, Agent, or Firm*—Ladas and Parry

(57) ABSTRACT

A sliding gate exhaust brake assembly comprising a gate located within an housing, the gate being moveable between an open position and a closed position to open and close an exhaust outlet. A first closeable pressure relief passage is provided for relieving exhaust gas pressure on the gate during opening of the gate and a second closeable pressure relief passage is provided for reducing exhaust gas pressure on the gate during closing of the gate. In a preferred embodiment the housing is divided into an input chamber and an exhaust chamber by a partition wall having an aperture closeable by the gate. The first pressure relief passage is provided by an closeable aperture through the gate and the second pressure relief passage is provided by a second closeable aperture in the partition wall.

21 Claims, 7 Drawing Sheets

Figures 1A, 1B, 1C:
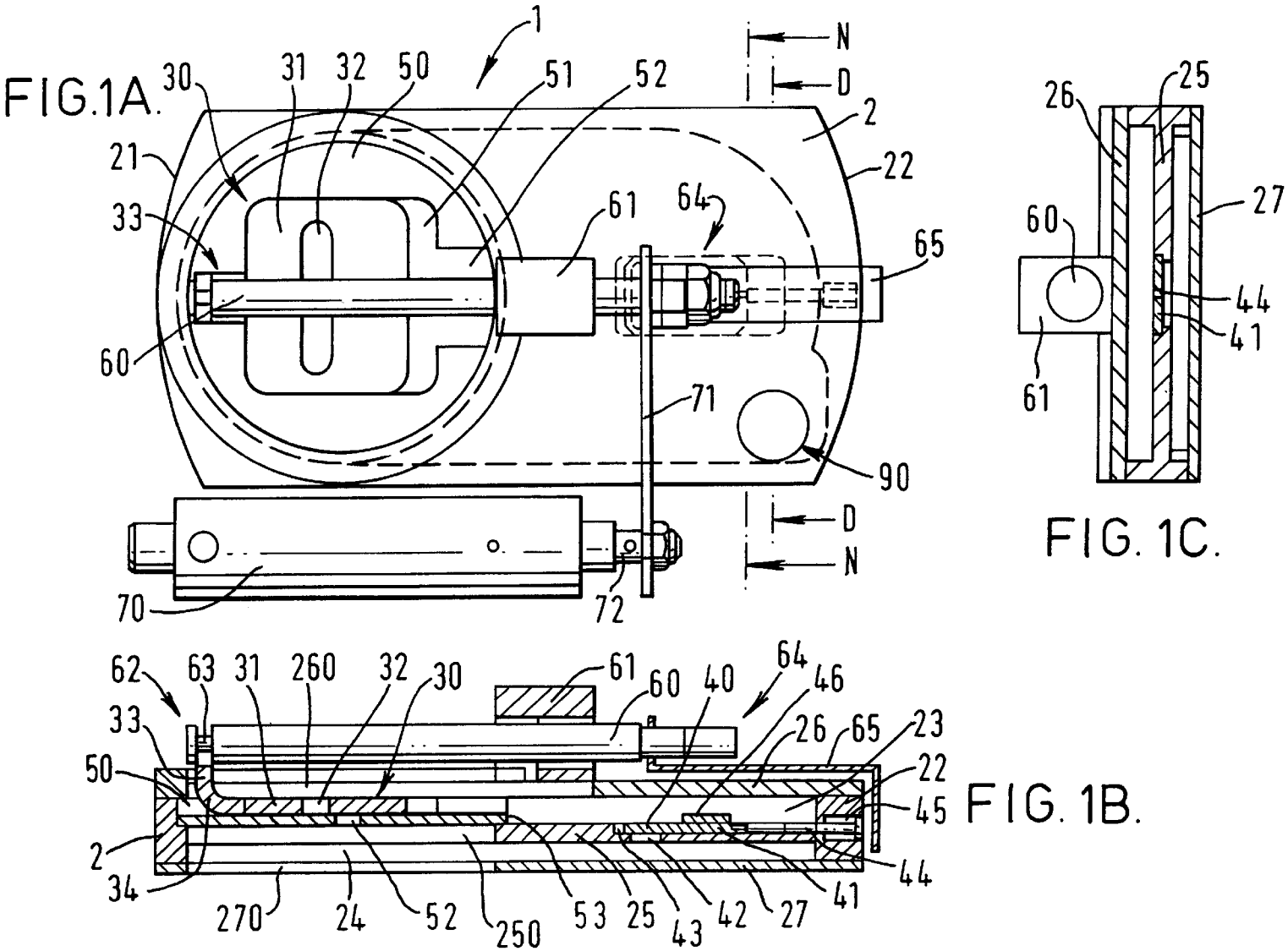

1
2
21
22
23
24
25
26
27
30
31
32
33
34
40
41
42
43
44
45
46
50
51
52
53
60
61
62
63
64
65
70
71
72
90
250
260
270
N
D

FIG. 3A.
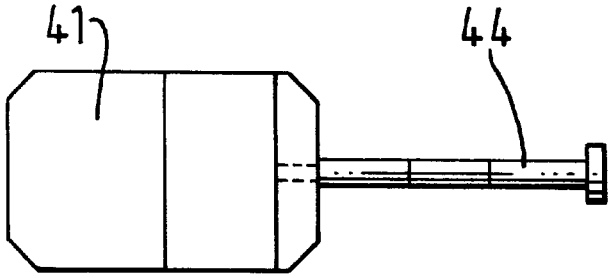
FIG. 3B.
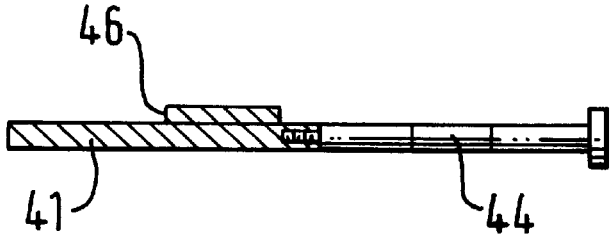
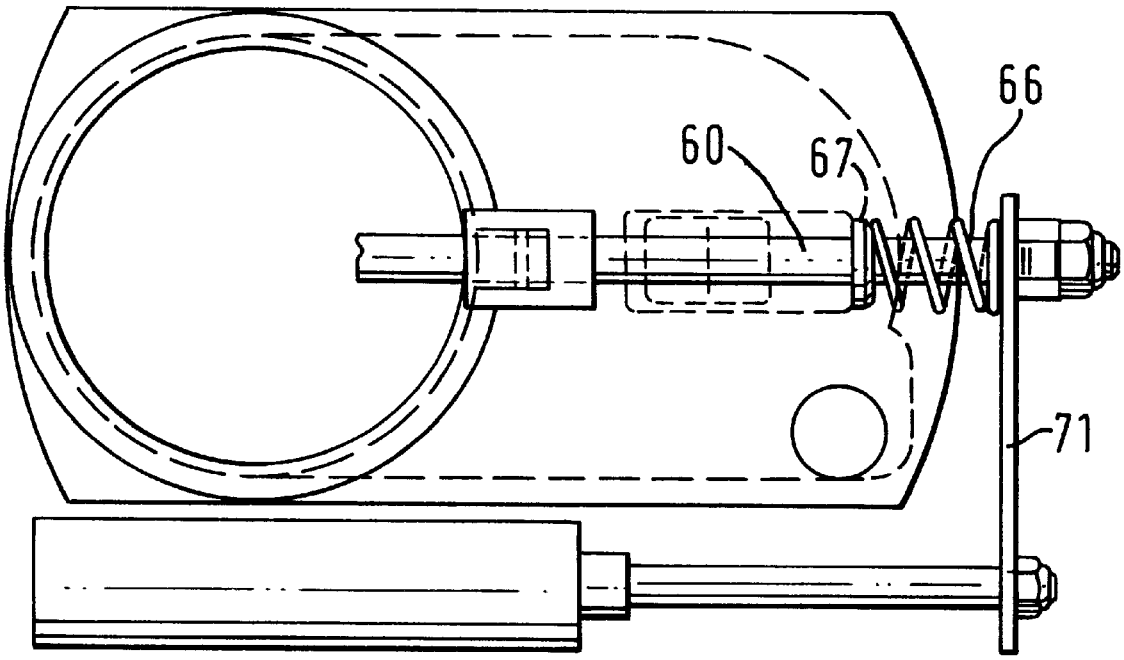
FIG. 4.

SLIDING GATE EXHAUST BRAKE ASSEMBLY

This invention relates to a sliding gate exhaust brake assembly.

Exhaust brakes are known for location in the exhaust system of internal combustion engines of motor vehicles to provide additional braking of the vehicle. Exhaust brakes operate by obstructing an outflow of exhaust gases from the engine to build up pressure in the exhaust manifold so that back pressure acts on the pistons during their compression strokes to create a retardation effect, which is transferred through the vehicle's transmission system to the road wheels to act as a non-fade supplementary braking system. Known sliding gate exhaust brake assemblies comprise a housing having aligned inlet ports and outlet ports and a slidable gate within the housing for sliding between an open position in which exhaust gases flow through the exhaust brake assembly and a closed position in which the gate closes at least one of the ports to build up pressure in the exhaust manifold. In known devices the gate is moved from the open position, against a force exerted by a return spring, by a piston of a single-action pneumatic or hydraulic cylinder.

To avoid possible damage to the engine by excessive pressures created by the exhaust brake, it is known to incorporate pressure relief features into the exhaust brake, for example, by providing an aperture through the gate. This sets a maximum pressure that can be generated in the exhaust manifold by the exhaust valve, but has a disadvantage that the aperture has to be of such a size to prevent overpressure when the engine is working at maximum speed and is, therefore, larger than required when the engine is not working at maximum speed, resulting in less than optimum back pressure being generated by the exhaust brake except at maximum working speed.

U.S. Pat. No. 4,556,027 discloses an exhaust brake in which the opening of the exhaust valve is continuously variable to maintain a required pressure.

EP 0250310 and U.S. Pat. No. 4,669,585 disclose a slidable gate assembly having an exhaust gas relief passage within the gate with a closure device which is biased to the closed position and is forced open by overpressure of the exhaust gas in the exhaust manifold.

PCT/GB94/01300 discloses a slidable gate valve with an aperture having a control arrangement which is preselectably variable according to driving conditions, to prevent over-severe braking in poor driving conditions.

The manifold pressures generated by known exhaust brakes may be over 450 kPa (65 psi). At such a pressure it is found in a 100 mm diameter exhaust system that a force of at least 1,090 N (245 lbf) is required to operate the gate to overcome the pressure of exhaust gases on a closed gate or the reaction forces caused by increasing pressure of exhaust gases on a closing gate and the force of the return spring. This requires a return spring and a piston and cylinder of such a size that the overall size of the exhaust brake is too bulky to use in many modern commercial vehicles, because legal requirements of noise and pollution emission control result in the space in which to install an exhaust brake being extremely limited. As a result, in such situations it is necessary to use known less effective and less robust butterfly valve type exhaust brakes. This disadvantage of the present exhaust valves is particularly acute in the case of turbo charged engines. It is well known, as discussed below, that the optimum position for an exhaust brake in a turbo charged engine is upstream of the turbo charger between the exhaust manifold and turbo charger. Prior art slide valve exhaust brakes have been excluded from this application primarily owing to their size and weight. In addition, butterfly type exhaust brakes are not suitable for mounting upstream of a turbo charger because the high velocity, extremely hot, exhaust gases acting under high pressure have the effect of eroding edges of a closure disk of the butterfly brake and these eroded particles may pass into the vanes of the turbo charger. This can unbalance the vanes and, since the turbo charger vanes may be rotating at over 100,000 rpm, may result in the destruction of the turbo charger.

Furthermore, it is often required to use an exhaust brake in combination with an engine compression release brake, since such a combination gives an increased amount of retardation than is available from either type of brake individually. A known compression release brake operates by altering the valve timing of the engine to use what would normally be the compression stroke to brake the engine, releasing the high pressure which has been built up against the piston at close to top dead centre. This pressure is released into the exhaust system where it is maintained by the exhaust brake, increasing the back pressure on the pistons. The effect of this combination is limited if the exhaust brake is placed downstream of the turbo charger. In this position, the pressure generated by the exhaust brake has the effect of slowing the turbo charger, thereby reducing the amount of air being delivered by the turbo charge vanes to the engine which has a marked effect on the compression release brake, which is dependent on an adequate air supply to the cylinders for its retarding effect.

It will be understood that the exhaust system may be connected to the exhaust aperture in a known manner and the exhaust manifold may be connected to the input chamber by a gas-tight joint passing around the periphery of the input aperture and around the operating rod housing.

It is an object of this invention to provide a sliding gate exhaust brake assembly in which these disadvantages are substantially overcome and thereby to provide an exhaust brake assembly which can be used in applications in which known exhaust brake assemblies cannot be used.

According to one aspect of the present invention there is provided a sliding gate exhaust brake assembly for closing an exhaust outlet, the assembly comprising gate means located within a housing, the gate means being moveable between an open position and a closed position, the assembly further comprising a first pressure relief passage having first closure means openable for relieving exhaust gas pressure on the gate means during movement from the closed position to the open position thereof, and the assembly further comprising a second pressure relief passage having second closure means openable for reducing exhaust gas pressure on the gate means during movement from the open position to the closed position thereof.

Advantageously, the first pressure relief passage is a gate aperture through the gate means and the first closure means include a first closure plate, slideable on the gate means between a gate closing position and a gate opening position, for closing and opening the gate aperture.

Conveniently, the first closure plate is provided with a first closure plate aperture for alignment with the gate aperture in the gate opening position.

Advantageously, the assembly further comprises operating rod means and the first closure means include engagement means for engagement with the operating rod means for movement of the first closure means by the operating rod means between the gate opening position and the gate closing position.

Conveniently, the first closure means are adapted to open the first relief passage before opening the gate means.

Preferably, the housing is divided into an input chamber and an exhaust chamber by a partition wall therebetween.

Conveniently, the second relief passage is formed by a closeable passage in the partition wall.

Advantageously, the second closure means include a second closure plate, slideable on the partition wall between an open position and a closed position of the closeable passage.

Conveniently, the second closure means are provided with engagement means for engaging the gate to move the second closure means from the closed position to the open position of the closeable passage in the partition wall.

Conveniently, the second closure means includes operating pin means for passing through a wall of the housing and the operating rod means have engagement means for engaging the operating pin means in the open position of the closeable passage to close the closeable passage with the second closure means.

Advantageously, a pressure relief valve is provided in the partition for relieving pressure between the input chamber and the exhaust chamber.

Advantageously, valve biasing means for biasing the pressure relief valve closed are located exterior to the housing.

Preferably, the pressure relief valve is adjustable for opening at predetermined pressures.

Conveniently, the operating rod means are activated by linkage means connected to a piston rod of an operating cylinder.

Advantageously, the operating cylinder is located alongside the housing.

Conveniently, the piston rod passes through a transverse portion of a longitudinal wall of the housing.

Conveniently, the second closure means are adapted to close during overtravel of the piston rod after closure of the gate means.

Advantageously, the overtravel of the piston rod acts against bias of linkage bias means interposed between the linkage means and collet means located on the operating rod means.

Preferably, the linkage bias means is a spring.

Conveniently, the brake assembly is adapted for use either upstream or downstream of a turbocharger.

Preferably, where the brake assembly is installed upstream of a turbocharger there is provided a high pressure outlet to the turbocharger.

The invention provides the advantage that by retracting the first closure plate to open the first pressure relief passage before opening the gate, pressure on the gate is released, so that a smaller force is required to open the gate than in the prior art. In addition, the provision of a by-pass passage which is open during closure of the gate prevents the build up of back pressure on the closing gate and consequently reduces the force necessary to close the gate. Taken together, these two features obviate the requirement for a heavy duty return spring for opening the gate and also mean that a smaller operating cylinder is required to operate the gate rather than the single action cylinder used in the prior art. Consequently, the overall size and weight of the exhaust is substantially less than in the prior art and, therefore, the exhaust brake assembly of the invention can be used in applications where exhaust brake assemblies of the prior art could not be used.

Moreover, the arrangement by which the operating cylinder is located alongside the exhaust brake housing rather than along an axial extension of the longitudinal axis of the housing, means that the operating rod reciprocates substantially within the length of the housing. This differentiates the invention from the prior art in which the operating rod and piston of the cylinder are co-linear. This arrangement facilities the use of a double-action cylinder, which is not feasible in the prior art co-linear designs, where the extremely hot operating rod (up to 400° C) would destroy a front nose seal as the operating rod was pulled through the seal. This substantially reduces the overall length of the exhaust brake assembly and produces a more compact assembly suitable for applications for which there is insufficient space for prior art exhaust brake assemblies.

Figure 1D:
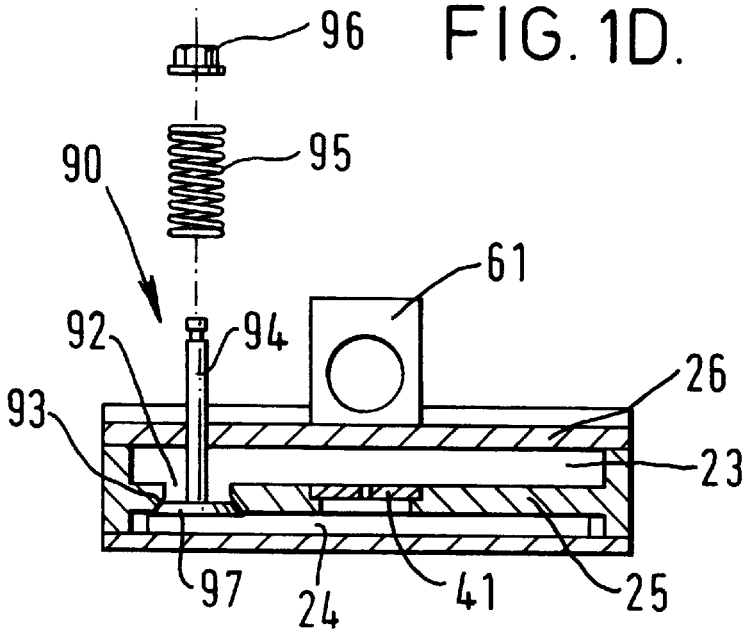

A specific embodiment of the invention will now be described by way of example, with reference to the accompanying drawings in which:

FIG. 1A—is a plan view of an embodiment of the invention;

FIG. 1B—is an axial cross-section of the embodiment of FIG. 1A;

FIG. 1C—is a transverse cross-section along line N—N in FIG. 1A;

FIG. 1D—is a transverse cross-section along the line D—D in FIG. 1A

Figure 2B:
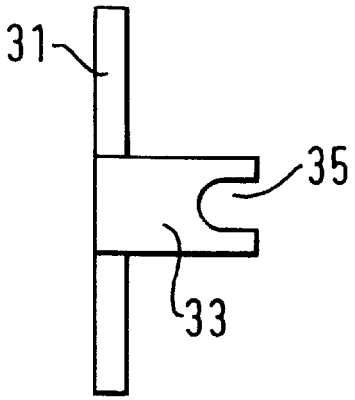
Figure 2A:
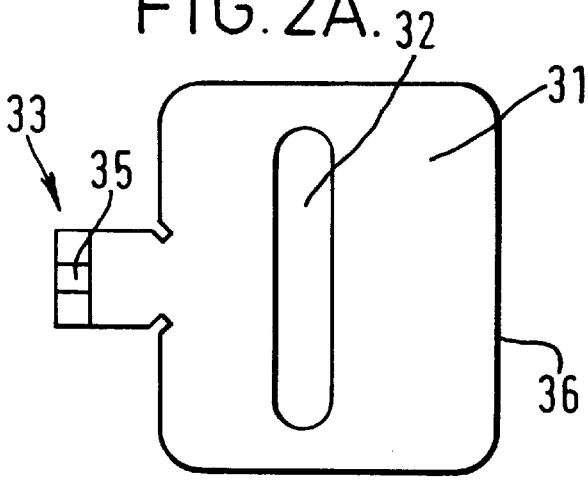
Figure 2C:
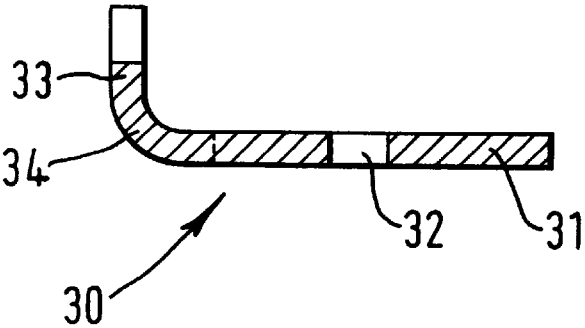
Figure 5:
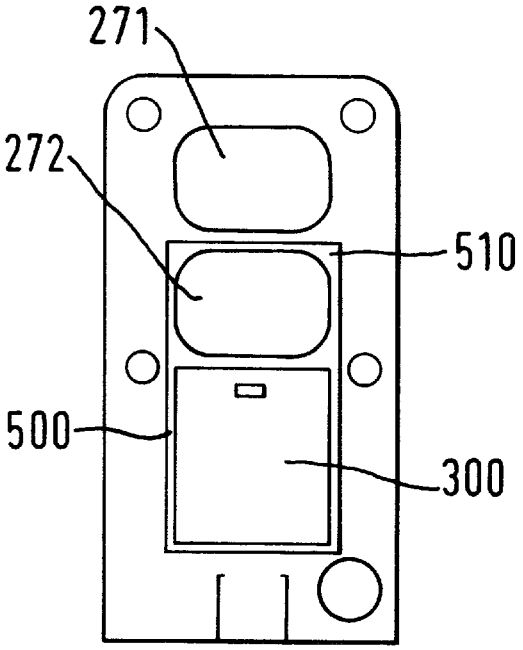
Figure 6:
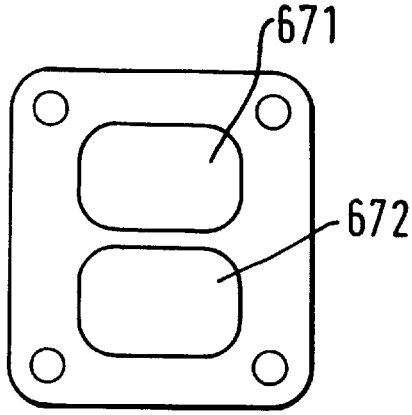
Figure 7A:
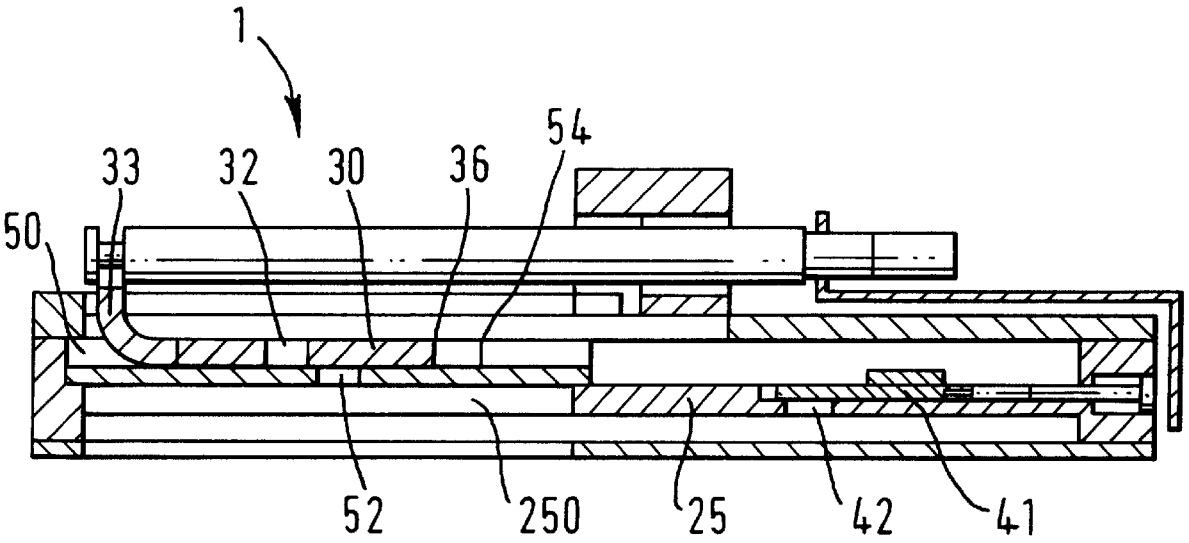

FIG. 2A—is a plan view of the first closure plate of the emodiment shown in FIG. 1A;

FIG. 2B—is a transverse end view of the first closure plate of FIG. 2A;

FIG. 2C—is an axial longitudinal cross-section of the first closure of FIG. 2A;

FIG. 3A—is a plan view of a second closure of the embodiment of FIG. 1A;

FIG. 3B—is a longitudinal cross-section of the second closure of FIG. 3A;

FIG. 4—is a plan view of a second embodiment of the invention;

FIG. 5—shows an exit port of a third embodiment of the invention;

FIG. 6—shows an inlet port of a turbo charger for use with the embodiment shown in FIG. 5; and FIGS. 7A—show the mode of operation of the embodiment shown in to 7F FIGS. 1A to 1D.

Figure 8:
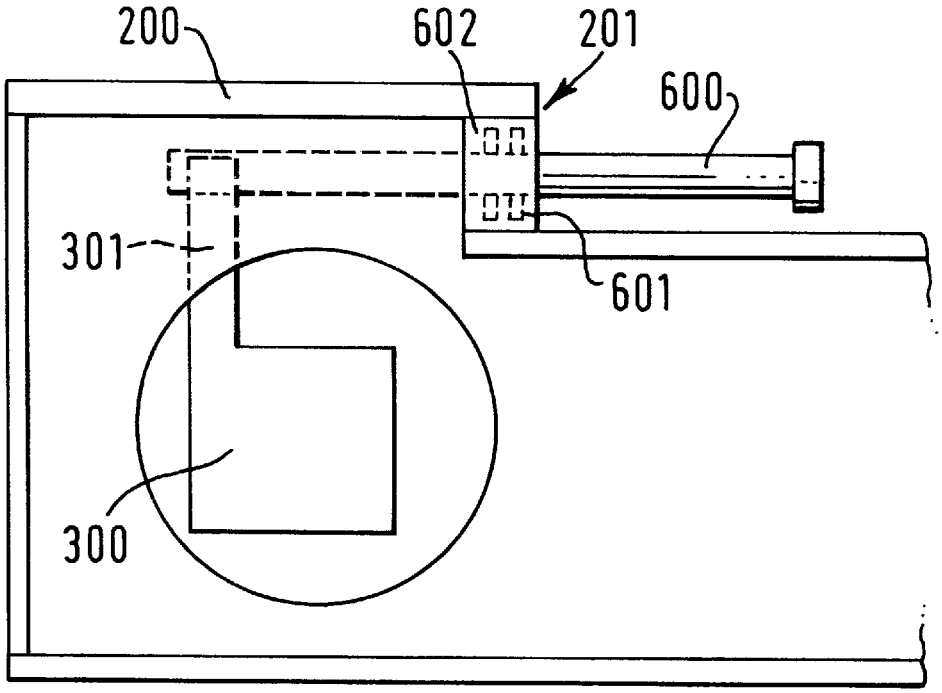

FIG. 8—shows a partial view of a fourth embodiment of the invention incorporating an alternative means of mounting an operating rod.

In the figures like reference numerals denote like parts.

As best seen in FIGS. 1 to 3, a first embodiment of the exhaust brake 1 is formed from a substantially cuboid housing 2 having substantially rectangular longitudinal and transverse cross-sections and having convex end walls 21, 22. The housing is divided into an input chamber 23 and an exhaust chamber 24 by a substantially central partition 25 parallel to the major faces of the housing. The major faces of the housing are formed from a top pressure container plate 26 and a bottom pressure container plate 27 respectively. The partition 25 forms a slide base plate for two closures 30,40 in a manner to be described. The top pressure plate 26 and the bottom pressure plate 27 are provided with aligned apertures 260,270 of circular cross-section and of a diameter commensurate with that of the width of the housing and are aligned with a first sliding base plate aperture 250 of commensurate diameter. To prevent exhaust gases passing through the exhaust brake in the closed position, the aperture 250 in the slide base plate 25 is closeable by a sliding gate 50 of circular cross-section and having a larger diameter than that of the aperture 250 in the slide base plate. It will be understood that a sliding gate having other than a circular cross-section could be used, provided the gate covers the aperture in the slide base plate. A substantially rectangular recess 51, with rounded corners, is provided in an upper surface, as seen in FIG. 1, of the gate 50 to receive a substantially rectangular first closure member 31 in the form of a plate, with rounded corners, having such a transverse dimension as to form a sliding fit within the recess 51 and a longitudinal dimension smaller than that of the recess 51 such that the first closure member 31 can move axially within the recess 51 between a gate opening position and a gate closing position. It will be understood that a recess and plate of another shape could be used, provided the closure plate is slideably located in the recess to close the aperture. The first closure member 31 is further provided with a transverse aperture 32 or slot which aligns with a corresponding slot 52 in the gate, in the gate opening position. It will be understand that more than one such slot may be provided or a slot or slots of other configurations could be used provided the slot or slots are closed in the gate closing position of the first closure member 31 and are open in the gate opening position of the first closure member. The first closure member 31 is further provided with an upturned tang 33 formed at right angles to the plane of the closure member and joined thereto by an arcuate portion 34 thereof, as best seen in FIG. 2. The upper end of the tang 33 furthest from the plate of the first closure member 31 is provided with a central unshaped recess 35 (see FIGS. 2A and 2B). In other embodiments a joined arm or a raised section may be provided in place of the tang 33 to engage the operating rod. The recess 51 in which the first closure member 31 is located is provided with a recessed passage 52 communicating between the recess 51 and the input chamber 23. There is further provided an operating rod 60 axially disposed above (in FIG. 1) the top pressure containing plate 26 slidably housed as a gas-tight fit in an operating rod housing 61, mounted on the outside of the top pressure containing plate 26 for reciprocal axial motion of the operating rod 60. The operating rod is provided proximate a first end 62 with a reduced diameter neck 63 for engagement with the u-shape recess 35 in the upturned tang 31 of the first closure means 30. The control rod 60 is connected proximate a second end 64, opposed to the first end 62, to a transverse driving plate 71 arranged perpendicular to the operating rod 60 and connecting the operating rod 60 to a piston rod 72 of an operating hydraulic or pneumatic cylinder 70 located parallel to the longitudinal axis of the brake assembly.

A portion of the slide base plate 25, remote from the aperture 250 closed by the gate 50, is provided with a second sliding base plate aperture 42, which is relatively small compared with the first sliding base plate aperture 250, connecting the input chamber 23 to the exhaust chamber 24 to provide a by-pass path for exhaust gases. This by-pass aperture 42 is closable by a second closure plate 41 slidable within a recess 43 in the slide base plate 25 and driven by an operating pin 44 passing through a gas-tight seal 45 in the end wall 22 of the exhaust brake remote from the input and exhaust apertures 260,270. As best shown in FIGS. 3A, 3B and 7C, an upper surface of the second closure plate is milled to provide a transverse ledge 46 such that the milled portion of the plate is co-planar with the top surface of the slide base plate 25 and the transverse ledge 46 projects above that plane for engagement with an end 53 of the gate 50. The control rod 60 is further provided with an axial z-shaped plate 65 fastened to the second end 64 of the control rod 60, the z-shaped plate 65 projecting past the end wall 22 of the exhaust brake housing for engagement with the operating pin 44 associated with the second closure plate 41 in a manner to be described.

Proximate a corner of the exhaust brake housing remote from the input and exhaust apertures 260,270, there is provided a relief valve 90 located in a further aperture 92 through the slide base plate partition 25 provided with a valve seating 93, a stem 94 of a co-operating valve 90 passing through the top pressure containing plate 26 in a gas-tight fit and biased by a spring 95 into the valve seating 93 to act as a pressure release valve between the input chamber 23 and the exhaust chamber 24 as best shown in figure 1D.

As shown in FIG. 4, an axial spring 66 may be provided on the operating rod 60 between the connecting plate 71 and a collet 67 located on the operating rod to provide over-travel of the operating rod after the gate 50 has been closed by the operating rod, in a manner and for a purpose to be described.

As shown in FIG. 5, in an embodiment of the exhaust brake for location upstream of a turbo charger, the exhaust port of the exhaust brake may be in the form of a pair of adjacent ports 271,272 for matching with the input ports 671, 672 of a turbo charger, as shown in FIG. 6.

In this embodiment, both the exhaust port and the slide base plate have two ports, corresponding with a profile of a turbo charger input, whereas the gate 500 has a single port corresponding with the outer of the two ports in the sliding base plate, leaving a clear passage for exhaust gases. The first closure 300 rests on the rear of the gate 500 leaving the second port open with the brake off. To apply the exhaust brake, the first closure 300 is moved forward to close the first port in the gate and continues to travel until it makes contact with the end wall of the recess 510 in the gate whereupon further movement pushes the closure across the corresponding orifice in the slide base plate, with the first closure plate covering the second port, so the ports of the exhaust brake are fully closed.

By leaving a small correctly positioned orifice in the first closure plate or the gate, high air pressure which is developed in the manifold by the closed exhaust brake can be directed onto rotor vanes of a turbo charger maintaining its revolutions, so that the amount of air delivered to the inlet side of the engine is at optimum volume, allowing maximum retardation of the engine, particularly when combined with a pressure release type engine brake.

FIG. 8 shows another embodiment of the invention incorporating an alternative arrangement of an operating rod 600 driven by a piston (not shown) in a double acting cylinder wherein the operating rod is located parallel to but not along the axial line of the exhaust brake assembly and a wall 200 of the housing of the exhaust brake assembly is provided with an extension forming a dog-leg 201 in the wall such that the operating rod passes through a gas seal 601 in an aperture 602 of the dog-leg portion of the wall to engage a transverse extension 301 of the second closure plate 300.

The mode of operation of the exhaust brake assembly will now be described by reference to FIGS. 7A to 7F. The exhaust brake 1 is shown in a fully closed position in FIG. 7A in which the gate 50 closes the first aperture 250 in the slide base plate 25 and the first closure means 30 is in the gate closing position in which in the first closure means closes the aperture 52 in the gate 50. Furthermore, the bypass passage 42 in the slide base plate 25 is closed by the second closure means 41.

Figure 7B:
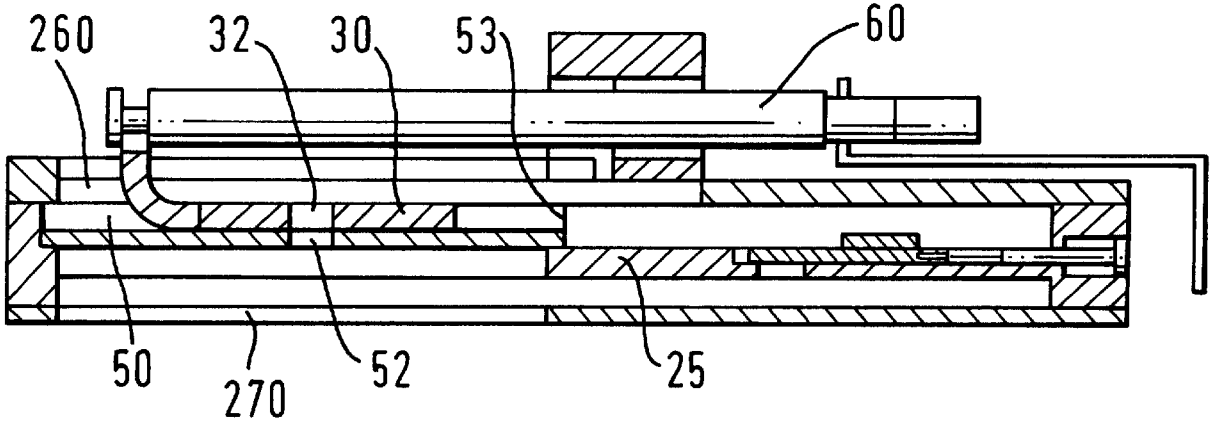
Figure 7C:
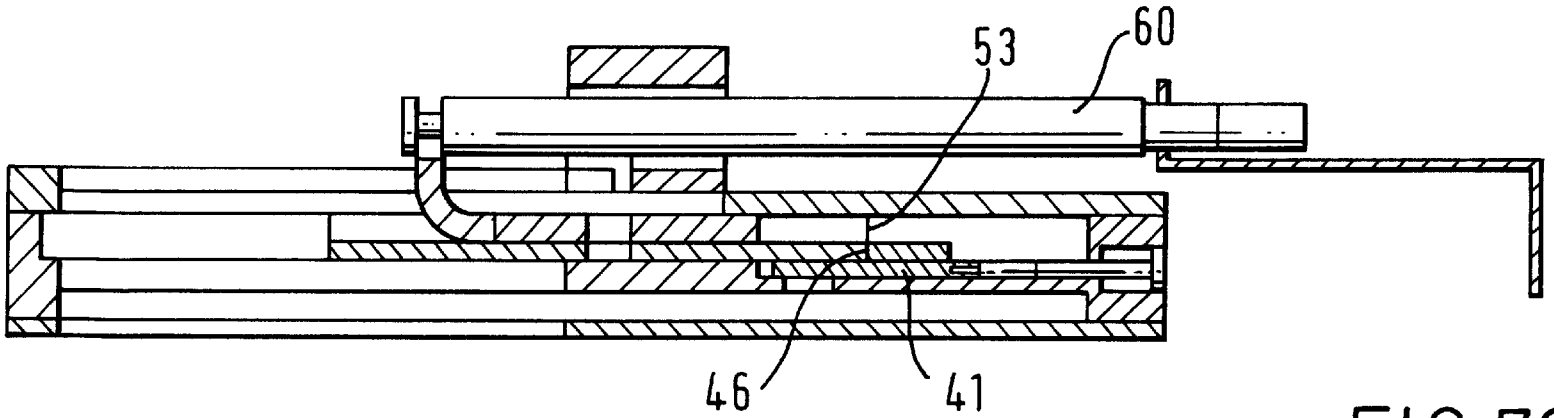
Figure 7D:
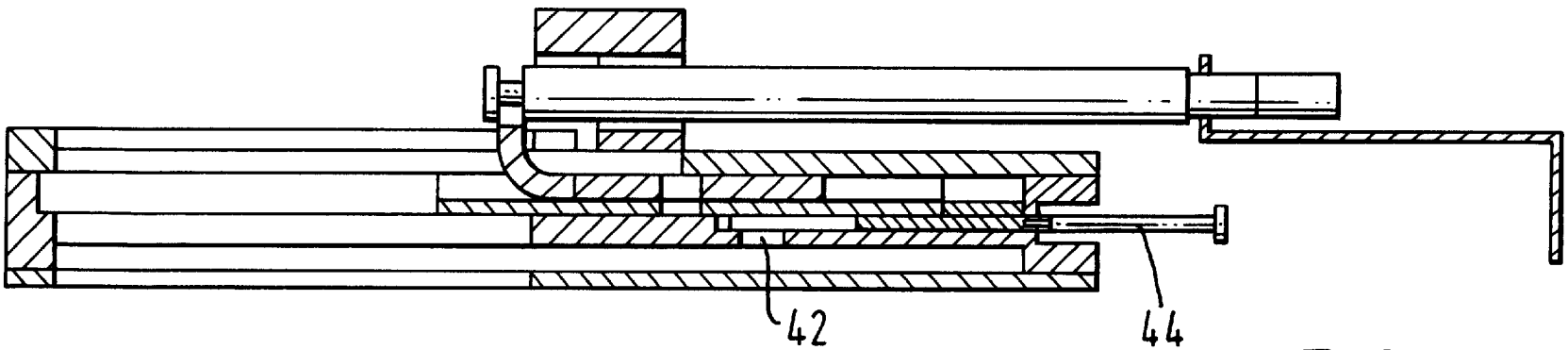

As shown in FIG. 7B, on release of the brake, the control rod 60 is first retracted by the operating cylinder 70 (see FIG. 1A) to a position in which the slot 32 in the first closure means 30 is aligned with the slot 52 in the gate 50, thereby releasing pressure from the exhaust manifold through the input port 260 into the exhaust system through the exhaust port 270 and thus releasing pressure on the gate 50. In this opening position of the first closure means 30 an end 36 of the closure plate furthest from the tang 33 engages a corresponding end wall 54 of the recess 51 in the gate 50 so that further movement of the control rod 60 opens the gate 50 by sliding the gate along the slide base plate 25. As shown in FIG. 7C, as the gate slides along the slide base plate, an end 53 of the gate engages the protruding ledge 46 of the second closure means 41 and further movement of the control rod 60 in the same direction moves the second closure plate 41 such that the bypass passage 42 is opened and the control pin 44 of the second closure protrudes from the brake housing as shown in FIG. 7D.

Figure 7E:
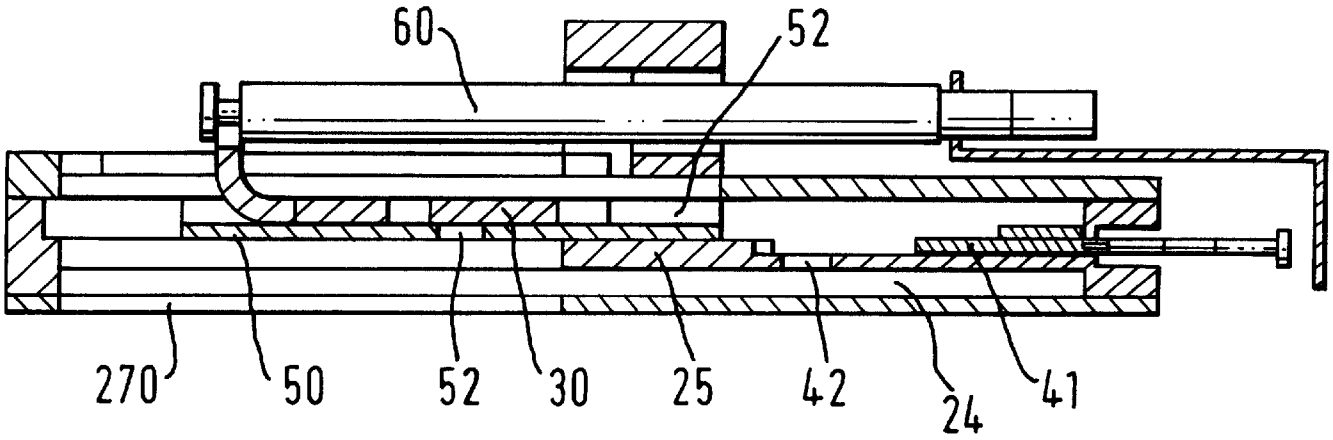

As shown in FIG. 7E, on re-applying the brake, the control rod is moved by the operating cylinder in the opposed direction to that used in releasing the brake, so that initially the first closure plate 30 is moved from the opening gate position to the closing gate position thereby closing the aperture 52 through the gate 50. As the gate is closed the bypass passage 42 through the slide base plate 25 remains open, allowing exhaust gases to escape through the connecting channel 52 in the upper surface of the gate 50 and through the bypass passage to the exhaust chamber 24 and thence through the exhaust port 270 to the exhaust system, thus preventing a build up of pressure on the gate as it is closed.

Figure 7F:
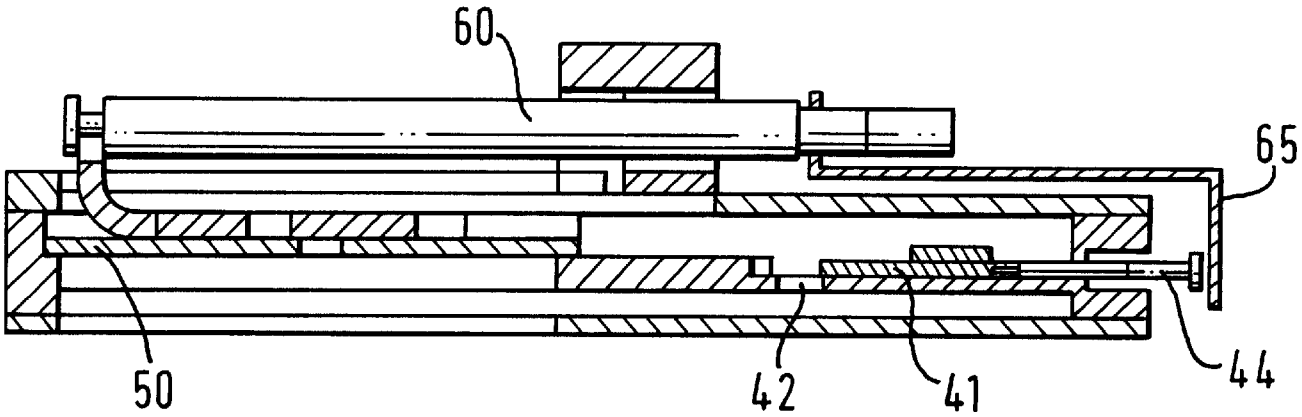

As best shown in FIG. 7F, once the gate 50 is closed, further over travel of the control rod forces the z-shaped plate 65 to engage the pin 44 of the second closure plate 41 thereby moving the second closure plate across the bypass aperture 42 and closing that bypass path so that pressure is built up in the exhaust manifold to retard the engine.

In an alternative embodiment, as the gate is opened, the control rod passes through the z-shaped plate until at a predetermined length of travel the z-shaped plate is contacted by a first striker attached to the control rod to move the z-shaped plate outwardly from the brake assembly. As the gate is closed the control rod again passes through the z-shaped plate for the predetermined distance until a second striker on the operating rod engages the z-shaped plate to move the second closure plate. The effect of this is to produce the amount of travel of the z-shaped plate, and thereby to limit the over-hang at the end of the brake assembly.

As described above, a relief valve 90 is provided as shown in FIG. 1D. An aperture 92 in the sliding base plate 25 is closed by a steel valve acting on the exhaust chamber 24 side of the sliding base plate 25 and is biased by a spring 95 acting between a collet 96 on the valve stem 94 and the top pressure containing plate 26, the stem 94 of the valve passing through the sliding base plate 25 and through the top pressure container plate 26 in a gastight fit. With the spring 95 located outside the housing 2, it is not subject to very high pressures or hostile atmosphere within the exhaust brake. When the exhaust gas pressure within the input chamber 23 of the exhaust brake reaches a pre-determined value, the pressure acting on the head 97 of the valve opens the valve to allow exhaust gases to pass into the exhaust chamber 24 and hence to the vehicle's exhaust system. Once the manifold pressure has fallen below the predetermined valve, the steel valve 90 will close. This cycle is repeated, the movement of the valve being so fast and small as to maintain an almost constant pressure within the exhaust manifold. Since the relief valve vents into the exhaust system, rather than into the atmosphere, there is no venting of exhaust gases into the engine compartment from where exhaust gases may otherwise enter the driving compartment.

It will be understood that instead of a cylinder and piston to operate the exhaust brake, a low-powered geared electric motor would provide sufficient power to open and close the gate against the reduced manifold pressure which is obtained by use of the first closure means and second closure means respectively during opening and closing of the brake.

What is claimed is:

1. A sliding gate exhaust brake assembly for closing an exhaust outlet, the assembly comprising gate means located within a housing, the gate means being moveable between an open position and a closed position, the assembly further comprising a first pressure relief passage having first closure means openable for relieving exhaust gas pressure on the gate means during movement from the closed position to the open position thereof, and the assembly further comprising a second pressure relief passage having second closure means openable for reducing exhaust gas pressure on the gate means during movement from the open position to the closed position thereof.

2. A sliding gate exhaust brake assembly as claimed in claim 1, wherein the first pressure relief passage is a gate aperture through the gate means and the first closure means include a first closure plate, slideable on the gate means between a gate closing position and a gate opening position, for closing and opening the gate aperture.

3. A sliding gate exhaust brake assembly as claimed in claim 2, wherein the first closure plate is provided with a first closure plate aperture for alignment with the gate aperture in the gate opening position.

4. A sliding gate exhaust brake assembly as claimed in claim 1, wherein assembly further comprises operating rod means and the first closure means include engagement means for engagement with the operating rod means for movement of the first closure means by the operating rod means between the gate opening position and the gate closing position.

5. A sliding gate exhaust brake assembly as claimed in claim 1, wherein the first closure means are adapted to open the first pressure relief passage before opening the gate means.

6. A sliding gate exhaust brake assembly as claimed in claim 1, wherein the housing is divided into an input chamber and an exhaust chamber by a partition wall therebetween.

7. A sliding gate exhaust brake assembly as claimed in claim 6, wherein the second pressure relief passage is formed by a closeable passage in the partition wall.

8. A sliding gate exhaust brake assembly as claimed in claim 7, wherein the second closure means include a second closure plate, slideable on the partition wall between an open position and a closed position of the closeable passage.

9. A sliding gate exhaust brake assembly as claimed in claim 7, wherein the second closure means are provided with engagement means for engaging the gate to move the second closure means from the closed position to the open position of the closeable passage in the partition wall.

10. A sliding gate exhaust brake assembly as claimed in claim 7, wherein the second closure means includes operating pin means for passing through a wall of the housing and the operating rod means have engagement means for engaging the operating pin means in the open position of the closeable passage to close the closeable passage with the second closure means.

11. A sliding gate exhaust brake assembly as claimed in claim 6, wherein a pressure relief valve is provided in the partition wall for relieving pressure between the input chamber and the exhaust chamber.

12. A sliding gate exhaust brake assembly as claimed in claim 11, wherein valve biasing means for biasing the pressure relief valve closed are located exterior to the housing.

13. A sliding gate exhaust brake assembly as claimed in claim 11, wherein the pressure relief valve is adjustable for opening at predetermined pressures.

14. A sliding gate exhaust brake assembly as claimed in claim 4, wherein the operating rod means are activated by linkage means connected to a piston rod of an operating cylinder.

15. A sliding gate exhaust brake assembly as claimed in claim 14, wherein the operating cylinder is located alongside the housing.

16. A sliding gate exhaust brake assembly as claimed in claim 14, wherein the piston rod passes through a transverse portion of a longitudinal wall of the housing.

17. A sliding gate exhaust brake assembly as claimed in claim 14, wherein the second closure means are adapted to close during overtravel of the piston rod after closure of the gate means.

18. A sliding gate exhaust brake assembly as claimed in claim 17, wherein the overtravel of the piston rod acts against bias of linkage bias means interposed between the linkage means and collet means located on the operating rod means.

19. A sliding gate exhaust brake assembly as claimed in claim 18, wherein the linkage bias means is a spring.

20. A sliding gate exhaust brake assembly as claimed in claim 1, wherein the brake assembly is adapted for use either upstream or downstream of a turbocharger.

21. A sliding gate exhaust brake assembly as claimed in claim 20, wherein there is provided a high pressure outlet to the turbocharger.

* * * * *